US007096542B2

(12) United States Patent
Hartung

(10) Patent No.: US 7,096,542 B2
(45) Date of Patent: Aug. 29, 2006

(54) METHOD AND APPARATUS AT A DRAW FRAME FOR FIBRE SLIVERS, FOR ADJUSTING THE NIP LINE SPACING OF A DRAWING MECHANISM

(75) Inventor: Reinhard Hartung, Mönchengladbach (DE)

(73) Assignee: Fa. Trutzschler GmbH & Co. KG, Monchengladbach (DE)

( * ) Notice: Subject to any disclaimer, the term of this patent is extended or adjusted under 35 U.S.C. 154(b) by 295 days.

(21) Appl. No.: 10/661,817

(22) Filed: Sep. 15, 2003

(65) Prior Publication Data

US 2004/0098837 A1 May 27, 2004

(30) Foreign Application Priority Data

Sep. 13, 2002 (DE) ..... 102 42 388
Jul. 2, 2003 (DE) ..... 103 29 836

(51) Int. Cl.
*D01H 5/74* (2006.01)

(52) U.S. Cl. ..... 19/260

(58) Field of Classification Search ..... 19/150, 19/152, 157, 159 R, 236–240, 260, 261, 19/258, 287, 288, 291, 292
See application file for complete search history.

(56) References Cited

U.S. PATENT DOCUMENTS 3,869,759 A * 3/1975 Savageau et al. ..... 19/293
4,768,262 A * 9/1988 Gunter ..... 19/258
6,088,882 A * 7/2000 Leifeld ..... 19/239
6,292,982 B1 * 9/2001 Breuer ..... 19/239

FOREIGN PATENT DOCUMENTS

DE 35 32 555 3/1987
EP 24 26 429 5/1975

* cited by examiner

*Primary Examiner*—Gary L. Welch
(74) *Attorney, Agent, or Firm*—Venable LLP; Robert Kinberg; Ryan M. Flandro

(57) ABSTRACT

In a method, at a draw frame for fibre slivers, of adjusting the nip line spacing of a drawing mechanism, which has at least two drawing mechanism roller combinations, of which at least one is so mounted that it can be adjusted, each drawing mechanism roller combination consists of at least one driven lower roller and at least one upper roller (press roller) lying, in operation, on top of the lower roller and so mounted that it can be lifted off.

In order to allow optimisation of specific drawing mechanism settings using the same fibre material, with fibre slivers inserted, a) the upper rollers are unloaded or lifted off, b) the mountings of at least one lower roller are unlocked, c) the mountings are adjusted to the desired nip line spacing using a displacement device, d) the mountings are subsequently re-locked.

67 Claims, 11 Drawing Sheets

METHOD AND APPARATUS AT A DRAW FRAME FOR FIBRE SLIVERS, FOR ADJUSTING THE NIP LINE SPACING OF A DRAWING MECHANISM

CROSS-REFERENCE TO RELATED APPLICATION

This application claims the priority of German Patent Application Nos. 102 42 388.1 filed Sep. 13, 2002 and 103 29 836.3 filed Jul. 2, 2003, the subject matters of which are incorporated herein by reference.

BACKGROUND OF THE INVENTION

1. Field of the Invention

The invention relates to a method, at a draw frame for fibre slivers, of adjusting the nip line spacing of a drawing mechanism, which has at least two drawing mechanism roller combinations, of which at least one is so mounted that it can be adjusted, wherein each drawing mechanism roller combination consists of at least one driven lower roller and at least one upper roller (press roller) lying on top of the lower roller and so mounted that it can be lifted off, and encompasses an apparatus for carrying out the method.

2. Description of Related Art

In practice, adjustment of the nip line spacings carried out without fibre slivers in the drawing mechanism, that is to say the fibre slivers are drawn off from the drawing mechanism completely and, subsequently, the nip line spacings are adjusted. It is not possible, by that means, to optimise existing drawing mechanism settings whilst using the same fibre material.

In a known appartus (DE-OS 20 44 996), the mountings of the intake and middle lower rollers are displaceable on the frame of the machine so that the extent of the drawing zone can be matched to the particular fibre staple. A tensioning pulley wheel, which is displaceable in a guideway in the frame of the machine, allows the length of the toothed belt to be modified in accordance with the changed spacing between the axes of the middle roller and a guide pulley wheel, brought about by displacement of the intake roller. The middle roller is driven by a further toothed belt. The latter toothed belt is tensioned by a tensioning pulley wheel which is fastened to the machine frame and which can pivot about one axis; as a result, it can also be matched to changed spacings between the axes of the intake roller and middle roller. It is disadvantageous that displacing devices for displacement of the intake roller and the middle roller and additional tensioning devices for re-tensioning of the toothed belts after the displacement operations are necessary, requiring a considerable outlay in terms of construction. In addition, it is disadvant-ageous that a number of work steps are required for the displacement operations and the subsequent re-tensioning operations. The belt tension is destroyed by the displacement process. Where the displacement is carried out manually, spacers are inserted between the mountings, the mountings being pushed against the spacers so that, in this case too, the amount of set-up work is considerable. Finally, the displacement and re-tensioning operations result in a doubling of potential error sources when setting the spacings and belt tensions.

SUMMARY OF THE INVENTION

The problem underlying the invention is accordingly to provide a method of the kind described at the beginning that avoids the disadvantages mentioned and that especially allows optimation of specific drawing mechanism settings using the same fibre material.

In an exemplary embodiment of the invention, a method for adjusting nip line spacing in a drawing mechanism of a draw frame for fibre slivers is provided. The drawing mechanism including at least two adjustable mounting devices defining a nip line spacing therebetween, each mounting device including at least one lower roller, at least one upper roller adjustably mounted on top of the lower roller, and at least one pulley wheel, the at least one pulley wheel in driving connection with a driving element. The method includes unlocking at least one of the at least two mounting devices; adjusting the nip line spacing between the at least two mounting devices via the drive element; and relocking the at least two mounting devices.

The fact that adjustment of the nip line spacings is carried out with fibre slivers inserted allows, in accordance with the invention, optimisation of specific machinery-related and/or fibre-related settings of the drawing mechanism using the same fibre material. The optimum extent of the drawing zone is dependent on, amongst other things, the length of fibres (staple length). It is likewise possible to determine and set an optimum drafting value.

The invention also encompasses an advantegous apparatus at a draw frame having a drawing mechanism for the doubling and drafting of fibre slivers, have a drawing mechanism from for accommodating the drawing mechanism, which has at least two pairs of rollers each comprising an upper roller and a lower roller, having means for adjusting the spacing of at least one of the lower rollers in relation to another lower roller, in each case having a mounting for accommodating the lower roller, wherein lower rollers are arranged to be driven by at least one drive element endlessly resolving around pulley wheels, wherein at least one pulley wheel and the tensioned guide element are used for adjusting a slider (mounting), wherein a moving force applied to the pulley wheel or to the drive element can be converted into the adjusting movement for the slider.

BRIEF DESCRIPTION OF THE SEVERAL VIEWS OF THE DRAWINGS

The invention will be described hereinafter in greater detail with reference to exemplary embodiments shown in the drawings, in which.

DETAILED DESCRIPTION OF THE INVENTION

Figure 1:
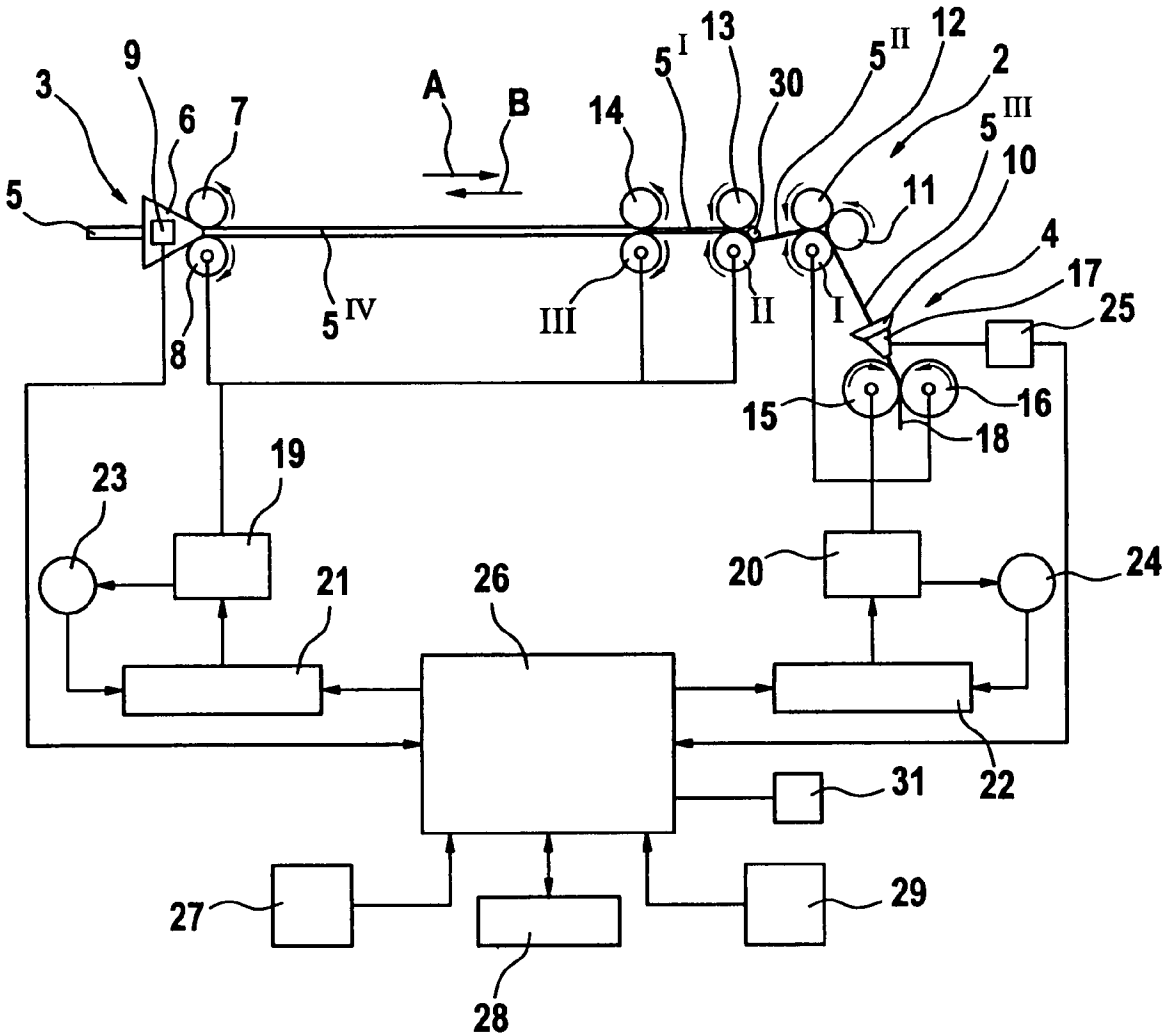
FIG. 1 shows, in a diagrammatic side view, an autoleveller draw frame for the apparatus according to the invention together with a general circuit diagram.

In accordance with FIG. 1, a draw frame 1, for example a Trü HSR draw frame, has a drawing mechanism 2, upstream of which is an intake 3 of the drawing mechanism and downstream of which is an exit 4 from the drawing mechanism. The fibre slivers 5, coming from cans (not shown), enter the sliver guide 6 and, drawn by the draw-off rollers 7, 8, are transported past the measuring element 9. The drawing mechanism 2 is designed as a 4-over-3 drawing mechanism, that is to say it consists of three lower rollers I, II, III (I delivery lower roller II middle lower roller, III intake lower roller) and four upper rollers 11, 12, 13, 14. Drafting of the fibre sliver combination 5' from a plurality of fibre slivers 5 is carried out in the drawing mechanism 2. Drafting is composed of preliminary drafting and main drafting. The roller pairs 14/III and 13/II an 11, 12/I form the main draft zone.

The attenuated fibre slivers 5 reach a web guide 10 in the exit 4 from the drawing mechanism and, by means of the draw-off rollers 15, 16, are drawn through a sliver funnel 17, in which they are combined to form one fibre sliver 18, which is then deposited in cans. Reference letter A denotes the work direction.

The draw-off rollers 7, 8, the intake lower roller III and the middle lower roller II, which are connected to one another mechanically, for example by toothed belts, are driven by the control motor 19, it being possible, in the process, for a desired value to be specified. (The associated upper rollers 14 and 13, respectively, revolve by virtue of the motion of the lower rollers.) The delivery lower roller I and the draw-off rollers 15, 16 are driven by the main motor 20. The control motor 19 and the main motor 20 each have their own controller 21 and 22, respectively. Control (speed-of-rotation control) is carried out in each case by means of a closed control loop, a tachogenerator 23 being associated with the control motor 19 and a tachogenerator 24 being associated with the main motor 20. At the intake 3 of the drawing mechanism, a variable proportional to the weight of the fibre slivers 5 fed in, for example their cross-section, is measured by an intake measuring element 9 known, for example, from DE-A- 195 37 983. A central computer unit 26 (control and regulation device), for example a micro-computer with a microprocessor, sends a setting for the desired value for the control motor 19 to the controller 21. The measurement values of the two measuring elements 9 and 25 are sent to the central computer unit 26 during the drawing process. The desired value for the control motor 19 is determined in the central computer unit 26 from the measurement values of the intake measuring element 9 and from the desired value for the cross-section of the delivered fibre sliver 18. The measurement values of the exit measuring element 25 are used for monitoring of the delivered fibre sliver 18 (delivered sliver monitoring). By means of this control system, it is possible for variations in the cross-section of the fibre slivers 5 fed in to be compensated, and for the fibre sliver to be made more uniform, by appropriately regulating the drafting process. Reference numeral 27 denotes a display monitor, 28 an interface, 29 an input device, 30 a pressure rod and 31 a memory.

Figure 2:
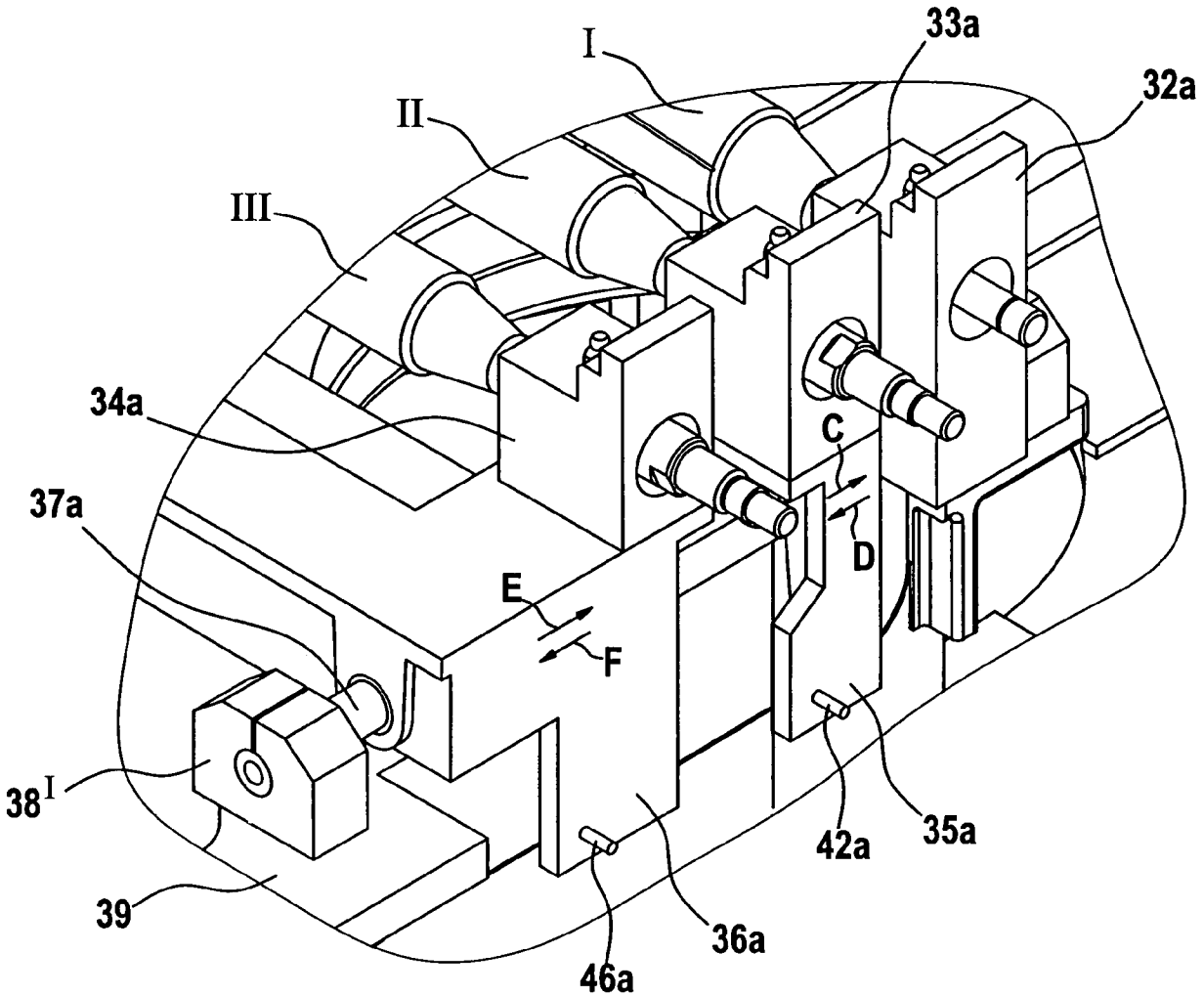
FIG. 2 shows the displaceable mounting of the intake and middle lower rollers.

In accordance with FIG. 2, the trunnions I*a*, II*a*, III*a* (see FIG. 3*b*) of the lower rollers I, II and III are mounted so as to be capable of rotation in mountings 32*a*, 33*a*, 34*a* (32*b*, 33*b*, 34*b* are located on the other side the drawing mechanism and are not shown). The mountings 33*a* and 34*a* are bolted onto sliders 35*a* and 36*a*, respectively, which are displaceable in the direction of the arrows C, D and E, F, respectively, along a bar 37*a*. The two ends of the bar 37*a* are fixedly mounted in mounting blocks 38' (38" not shown), which are attached to the frame 39 of the machine.

Displacement of the sliders 35*a*, 35*b*; 36*a*, 36*b* at the same time causes the mountings 33*a*, 33*b*; 34*a*, 34*b* and, as a result, the lower rollers II and III, respectively to be displaced and moved in directions C, D and E, F, respectively. The associated upper roller 13 and 14 are correspondingly moved (in a manner not show) in directions C, D and E, F, respectively. By that means, the nip line spacings between the roller combinations are modified and set.

Figure 7:
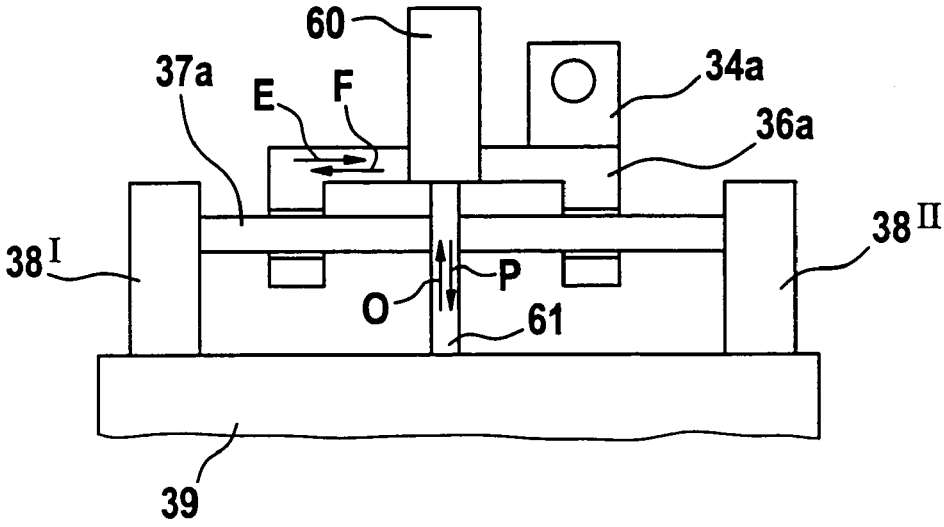
FIG. 7 shows a locking device for a slider.

Locking of the sliders 35*a*, 35*b*; 36*a*, 36*b* is accomplished by means of a catch device, stopping device or the like (see FIG. 7).

Figure 3A:
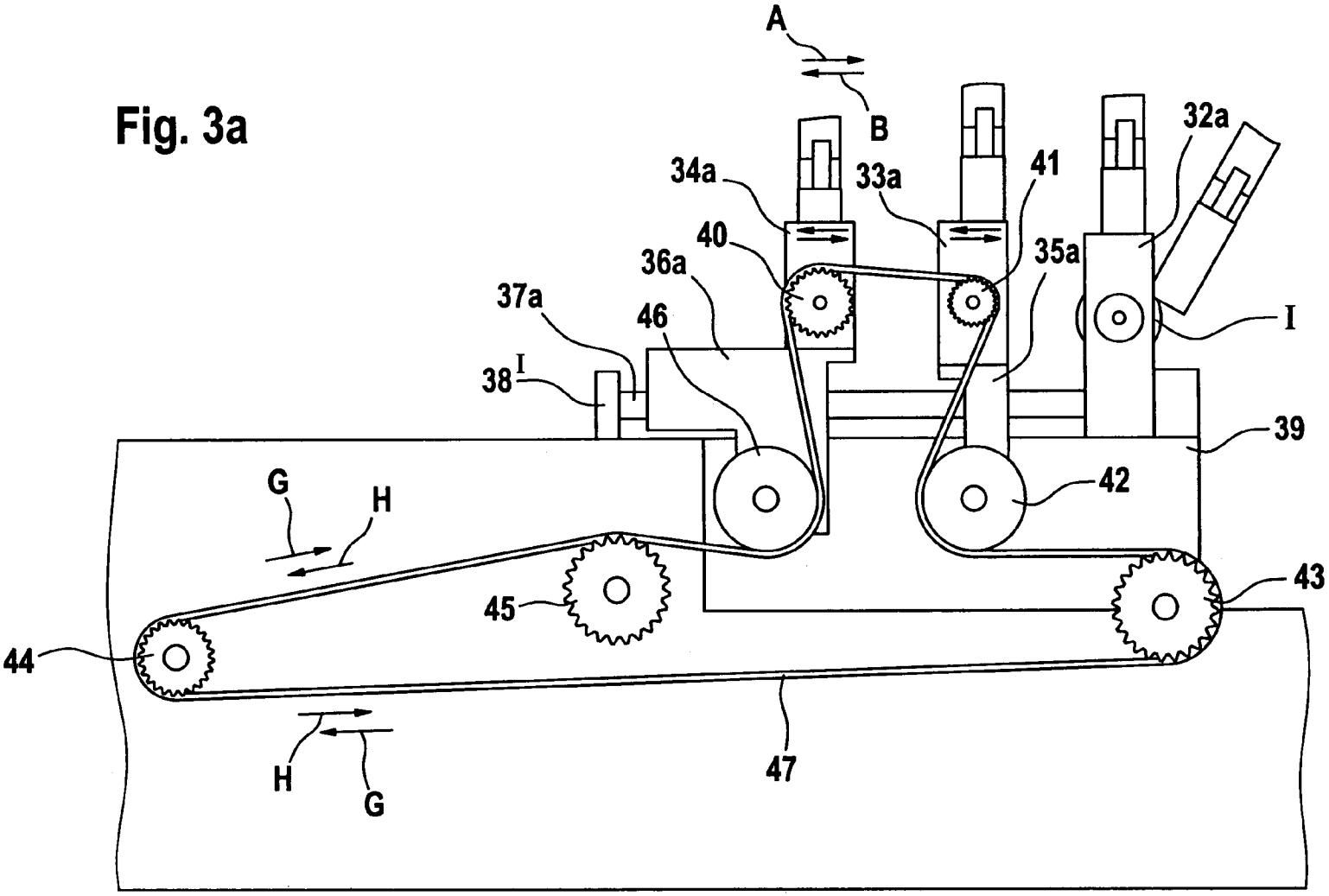
FIGS. 3*a* and 3*b* show the drive for the intake and middle lower rollers for the draw frame according to FIG. 1, in a side view (FIG. 3*a*) and plan view (FIG. 3*b*)
Figure 3B:
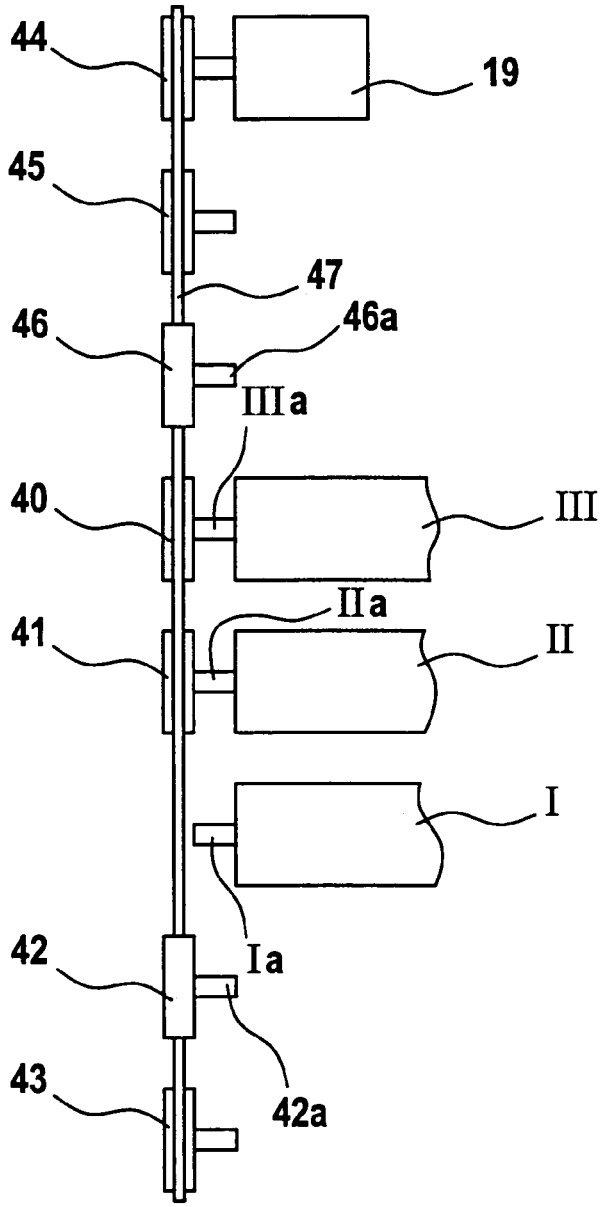

In accordance with FIG. 3*a*, the lower rollers II and III are driven from the right-hand side, seen in the direction material flow A, by means of a common loop mechanism in the form of toothed belt wheels 40, 41 and a toothed belt 47. The different speeds of rotation of the lower rollers II and III are achieved by means of change-gearwheels at the drive trunnions II*a*, III*a* provided with different numbers of teeth. The toothed belt 47 runs in direction B (that is to say contrary to the work direction) onto the control drive, which is in the form of a servo motor 19. The lower roller I is driven from the left-hand side of the machine by means of a look mechanism in the form of toothed belt wheels and a toothed belt 47. For that purpose, the toothed belt 47' runs on the left-hand side from the toothed belt wheel 40 at the lower roller I in direction G on to the servo motor 20.

Figure 3C:
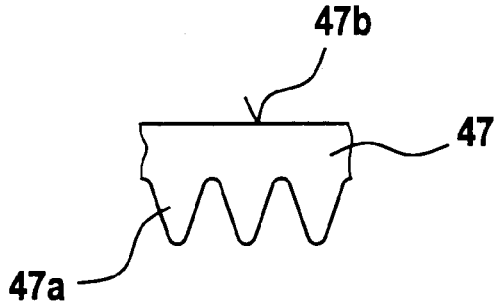
FIG. 3*c* shows a schematic side view of a toothed belt.

In operation, that is to say when the fibre slivers are running in direction A, the toothed belt 47 moves in direction G. Starting from the toothed belt wheel 47 arranged on the drive motor 19, the toothed belt 47 runs successively over a toothed belt wheel 45, a smooth guide pulley wheel 46, the toothed belt wheel 40 (roller-driving pulley wheel for the lower roller III), the toothed belt wheel 41 (roller-driving pulley wheel for the lower roller II), a smooth guide pulley wheel 42 and a toothed belt wheel 43. As shown in FIG. 3*c*, the belt 47 has a toothed side 47*a* and a smooth side 47*b*. By means of its teeth, the toothed belt 47, by means of teeth 47*a* (FIG. 3*c*), is in positive engagement with the toothed belt wheels 40, 41, 43, 44, and 45. The smooth side 47*b* (reverse) (FIG. 3*c*) of the toothed belt 47, opposite the toothed side, is in contact and in engagement with the smooth guide pulley wheels 46 and 42. The toothed belt 47 loops around all the pulley wheels 40 to 46. In operation (when the fibre slivers are running in direction A during drafting), the toothed belt wheels 40, 41, 43, 44, and 45 rotate clockwise and the guide pulley wheels 42 and 46 rotate anti-clockwise.

The toothed belt wheels 40, 41 are associated with the mountings 34*a* and 33*a*, respectively, whereas the guide pulley wheels 42, 46 are attached to the sliders 35*a* and 36*a*, respectively, in a manner allowing rotation. Because of the rigid attachment between the mounting 34*a* and the slider 36*a* and between the mounting 33*a* and the slider 35*a* (for example, by means of bolts), there are associated with the lower rollers II and III, in each case, one toothed belt wheel 40 to 41 and one guide pulley wheel 46 and 42, respectively. The toothed belt 47 runs around the pulley wheels 40, 46, on the one hand, and round the pulley wheels 41, 42, on the other hand, in a mirror-reflected arrangement (see FIG. 3*b*).

Figure 4A:
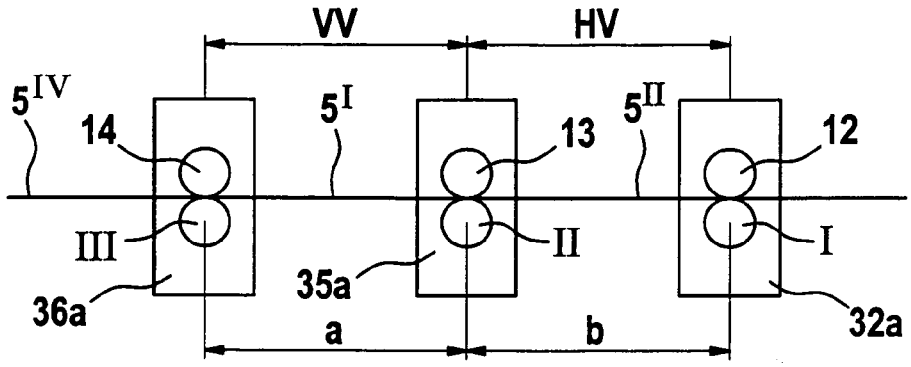
FIGS. 4*a* to 4*d* show, in diagrammatic form, the sequential procedure for shortening of the preliminary and main draft zones.

The zone between the pairs of rollers 13/II and 14/III is designated VV (preliminary drafting) and the zone between the pairs of rollers 12/I and 13/II is designated HV (main drafting) (see FIG. 4*a*). When, in accordance with FIG. 3*a*, the nip line spacing between the roller pairs 14/III and 13/II is to be increased, at least one pair of rollers must be moved away from the respective other pair of rollers. For that purpose the slider 35*a* may be displaced towards the right, which may be accomplished in two ways:

a) The slider 35*a* is unlocked. A pulley wheel, for example the toothed belt wheel 44, is stopped so that there is no possibility of rotation. Stopping may be accomplished, for example, by mechanical or electromagnetic means. As a result the toothed belt 47 is stationary and cannot be moved. The toothed belt wheel 41 is then rotated anti-clockwise, for example manually using a crank or the like, whereupon the guide pulley wheel 42 likewise rotates, clockwise, as a matter of necessity. In the process, the rotary movement of the toothed belt wheel 41 is converted into a longitudinal movement of the slider 35*a* in direction C, the toothed belt wheel 41 and the guide pulley wheel 42 winding along opposite sides of the stationary toothed belt 47, thereby "shortening", as it were, the toothed belt 47 at one pulley wheel and "lengthening" it at the other pulley wheel. The length of belt required during that "winding along " at the toothed belt wheel 41 is made available at the guide pulley wheel 42. The lower roller II is thereby displaced in direction C by means of the slide 35*a* and the mounting 33*a*.

The slider 35*a* is unlocked. The toothed belt wheel 41 is stopped so that there is no possibility of rotation. As a result the guide pulley wheel 42 is also stopped of necessity. Then, clockwise rotation is brought about by means of the drive motor 19. The toothed belt 47 moves in direction G, likewise "shortening" the belt 47 at one pulley wheel and "lengthening" it at the other pulley wheel. The length of belt actually required between the toothed belt wheels 40 and 41 is made available between the toothed belt wheels 43 and 42. The rotary movement of the toothed belt wheel 44 and the movement of the toothed belt 47 is thereby converted into a longitudinal movement of the slider 35*a* in direction C. The lower roller II, mounted in the mounting 33*a* (which is rigidly connected to the slider 35*a*), is likewise moved in direction C as a result.

In practice, it is often the case that, in accordance with FIGS. 4*a* to 4*d*, first the preliminary draft zone VV is modified and then the main draft zone HV. In the case of shortening of the draft zones VV and HV, the slider 36*a* is displaced in the direction of the arrow E from the position according to FIG. 4*a* into the position according to FIG. 4*b*. As a result, the nip line spacing in the prelim-inary draft zone VV is reduced from "a" "a '". Then, in accordance with FIG. 4*c*, the sliders 36*a* and 35*a* are rigidly connected to one another by means of a bridge 50. Finally, the rigidly coupled sliders 36*a* and 35*a* are moved, in accordance with FIG. 4*d*, in the direction of the arrows E and C, from the position shown in FIG. 4*c* into the position shown in FIG. 4*d*. As a result, the nip line spacing in the main draft zone HV is shortened from "b" to "b'". —A corresponding procedure is used in the case of lengthening the preliminary and main draft zones, that is to say the coupled sliders 35*a* and 36*a* are displaced in the direction of the arrows F and D (see FIG. 2), as a result of which the main draft zone HV is lengthened. The, the sliders 35*a* and 36*a* are uncoupled from the bridge 50. Finally, the slider 36*a* is moved in the direction of the arrow F (see FIG. 2), as a result of which the preliminary draft zone VV is lengthened.

Figure 4B:
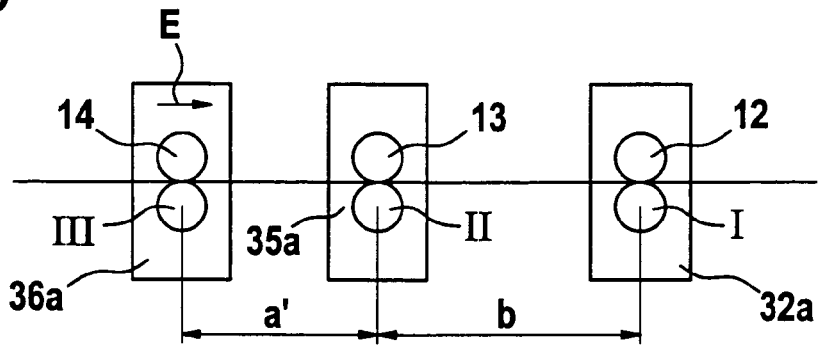
Figure 4C:
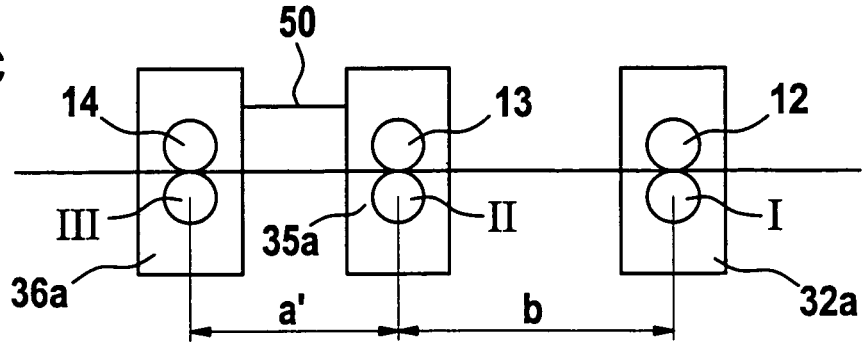
Figure 4D:
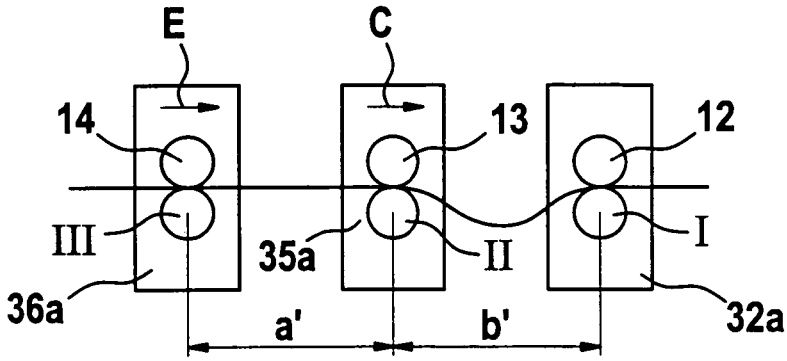

With regard to the fibre slivers 5 in the drawing mechanism 2, it should be noted that, in the case of shortening of the draft zones VV and HV, a small amount of stretching, in direction B, of the fibre slivers $5^{IV}$ upstream of the pair of rollers 14/III can occur on displacement in accordance with FIGS. 4*a*, 4*b*, but because of the length (about 1.5 m) of the spacing between the transport rollers 7, 8 and the pair of rollers 14/III this is without significance. In the case of shortening, a sagging loop does not form in the preliminary draft zone VV because in the case of displacement referring to the pairs of roller 14/III and 13/II either one or both pairs of rollers are rotatable because the drives to both pairs of rollers are coupled by way of the toothed belt 47. In contrast, in the case of shortening of the main draft zone HV, a sagging loop is formed in fibre slivers 5", which is drawn out or drawn straight by rotation of the pair of rollers 12/I in the work direction A by means of the main motor 20. —In the case of lengthening of the draft zones VV and HV, the pair of rollers 12/I is, in a first step, rotated backward in direction B, whereupon a sagging loop is intentionally formed in the fibre slivers 5". When the main draft zone HV is subsequently lengthened by displacement of the couple sliders 35*a* and 36*a* in direction D an F, the artificially formed loop is, in the process, once again drawn out or drawn straight. Finally, after uncoupling of the bridge 50, the slider 36*a* is displaced in direction F. As a result of the above-mentioned coupling of the drives to the intake and middle lower roller pairs by means of the toothed belt 47, the length of the fibre slivers 5' in the preliminary draft zone VV remains unaffected. Possible slight compression of the fibre slivers $5^{IV}$ upstream of the pair of rollers 14/III is, in respect of the drafting and the constitution of the fibre slivers $5^{IV}$, without significance.

Figure 5A:
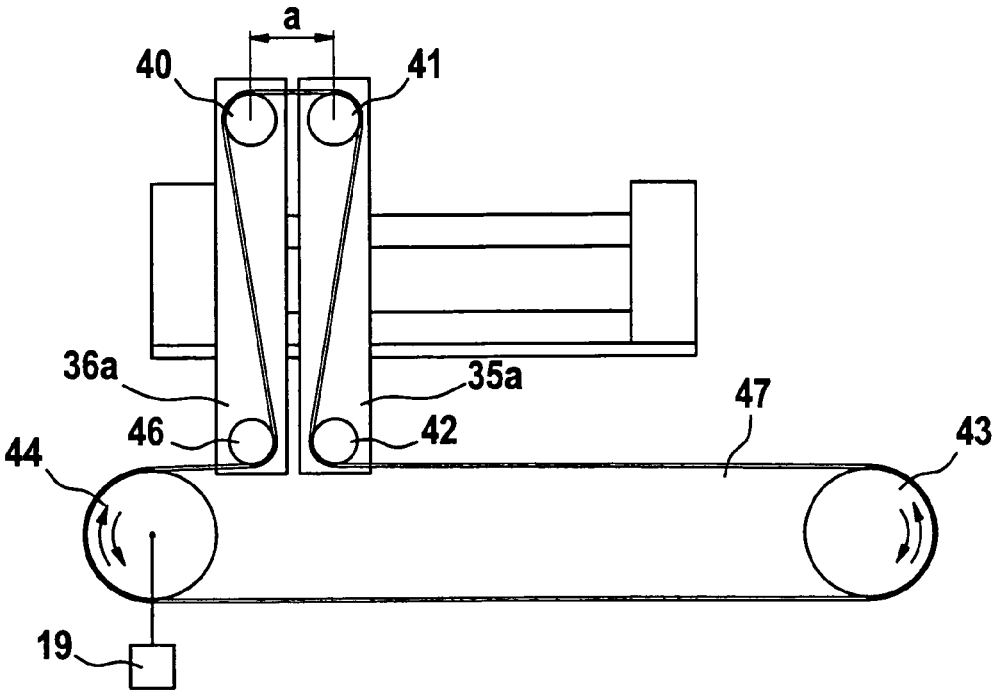
FIGS. 5*a* and 5*b* show the intake and middle lower rollers before displacement (FIG. 5*a*) and after displacement (FIG. 5*b*)
Figure 5B:
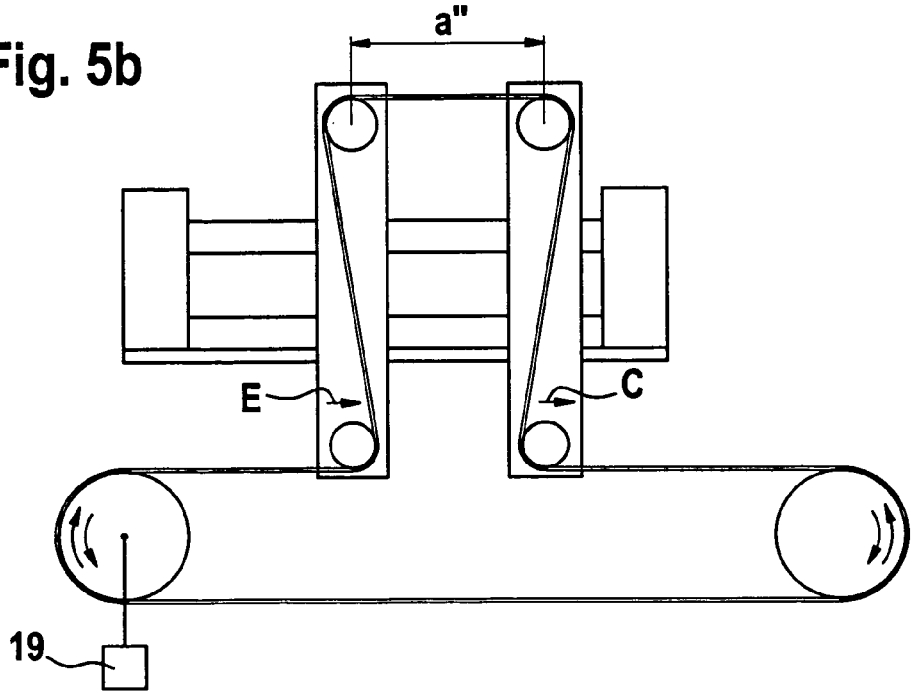

FIGS. 5*a*, 5*b* show the construction bringing about the displacement of the sliders 36*a* and 35*a*. The nip line spacing in the preliminary draft zone VV is lengthened from "a" (FIG. 5*a*) to "a"" (FIG. 5*b*). The sliders 36*a* and 35*a* are displaced one after the other according to the arrows E and C, respectively. Displacement is accomplished by stopping the toothed belt wheel 40 or fixing it with a holding brake or the like and then actuating the drive motor 19, whereupon the toothed belt 47 moves. In continuation thereof, the sliders 36*a* and 35*a* are displaced in accordance with FIGS. 4*a*, 4*b* and, subsequently, FIGS. 4*c*, 44.

Figure 6A:
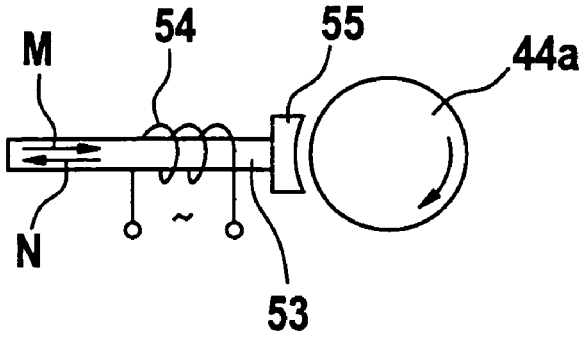
FIGS. 6*a* and 6*b* show, in diagrammatic form, an electromagnetic braking apparatus for a toothed belt wheel.
Figure 6B:
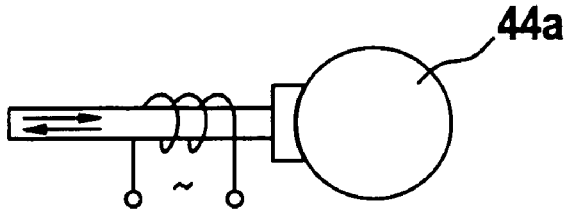

In accordance with FIG. 6*a*, an electromagnetic holding brake is provided, which has a rod-shaped iron core 53 surrounded by a plunger coil 54. Mounted on one end face of the iron core 53 is a brake shoe 55, for example made of plastics material or the like. The iron core 53 is displaceable in the direction of the arrows M, N. When current flows through the plunger coil 54, the iron core 53 is moved in direction M, in accordance with FIG. 6*b*, so that the brake shoe 55 is pressed against the smooth cylindrical surface of the shaft 44*a* of the toothed belt wheel 44. As a result, the toothed belt wheel 44 is fixed (stopped) so that it cannot rotate, for as long as voltage is applied to the plunger coil 54.

In accordance with FIG. 7, a pneumatic cylinder 60 having a piston rod 61 is attached to the slider 36*a*. When subjected to pressure from the pneumatic cylinder 60, the piston rod 61 is moved out in the direction of arrow P and comes to rest, with a high degree of contact pressure, against the machine frame 19. The slider 36*a* is fixed (stopped) so that it cannot be displaced with respect to the bar 37*a,* for as long as compressed air is applied to the pneumatic cylinder 60.

Figure 8:
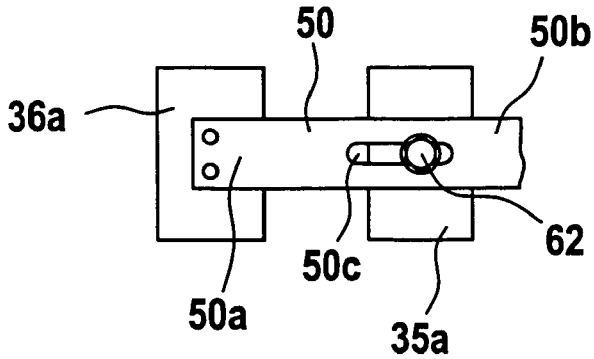
FIG. 8 shows a connection element (bridge) for connecting two sliders.

In accordance with FIG. 8, there is provided, as the bridge 50 between the sliders 35*a* and 36*a,* a flat piece of metal (plate), which is fastened in the region of one of its ends 50*a* to the slider 36*a,* for example using bolts. In its region 50*b* facing the slider 35*a,* the flat piece of metal has an elongate hole 50*c,* through which a bolt 62 can engage in a threaded hole (not shown) in the slider 35*a.* By means of this bridge 50, the sliders 35*a* and 36*a* can be rigidly connected to one another, releasably, at different spacings with respect to one another.

Figure 9:
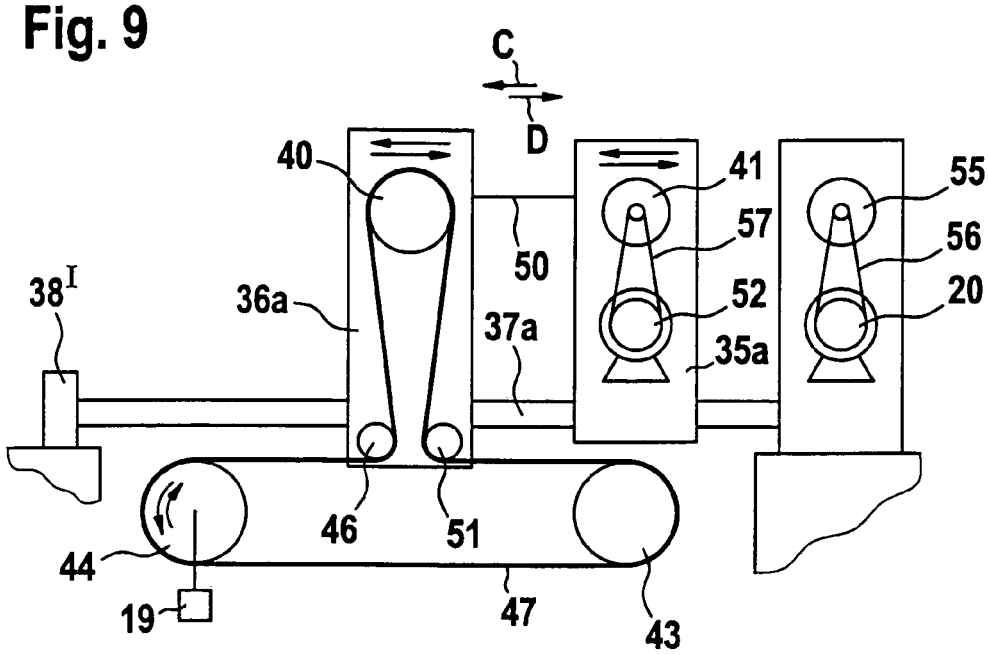
FIG. 9 shows an embodiment comprising a drawing mechanism having three roller combinations, each having its own drive motor.

In accordance with FIG. 9, in contrast to FIG. 1, each lower roller I, II and III is driven by its own drive motor 20, 52 and 19, respectively, as shown, for example, in DE-OS 38 01 880. The motor 20 drives the toothed belt wheel 55 of the lower roller I by way of the toothed belt 56; the motor 52 drives the toothed belt 57; and the motor 19 drives the toothed belt wheel 40 of the lower roller III by way of the toothed belt 47. Attached to the slider 36*a,* in addition to the smooth guide pulley wheel 46, is a further smooth guide pulley wheel 51. The endless toothed belt 47 loops around, in succession, the pulley wheels 44, 46, 40, 51 and 43. The toothed belt wheels 44, 40 and 43 are in engagement with the teeth of the toothed belt 47, whereas the smooth guide pulley wheels 46 and 51 are in engagement with the smooth reverse side of the toothed belt 47. The sliders 35*a* and 36*a* are rigidly connected to one another, releasably, by means of the bridge 50. When they are not connected by the bridge 50, the sliders 35*a* and 36*a* are individually displaceable and when they are connected by the bridge 50 they are jointly displaceable.

Figure 10:
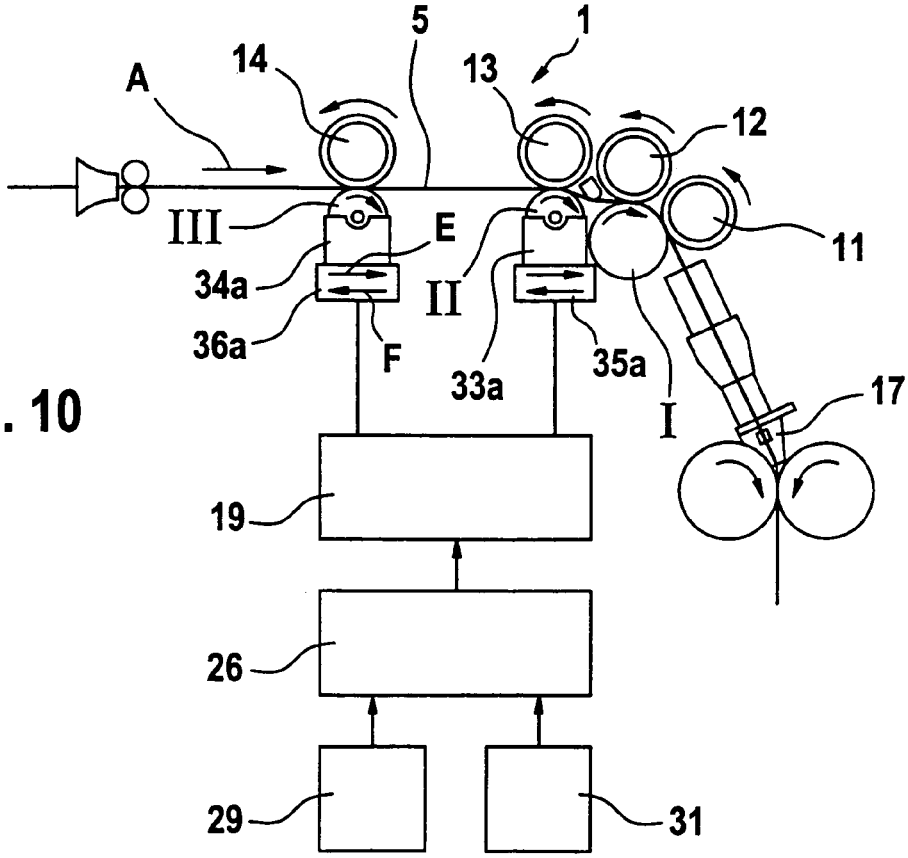
FIG. 10 shows input devices for manual and/or memory-assisted input of adjustment values for changing the nip line spacings in the drawing mechanism.
Figure 11:
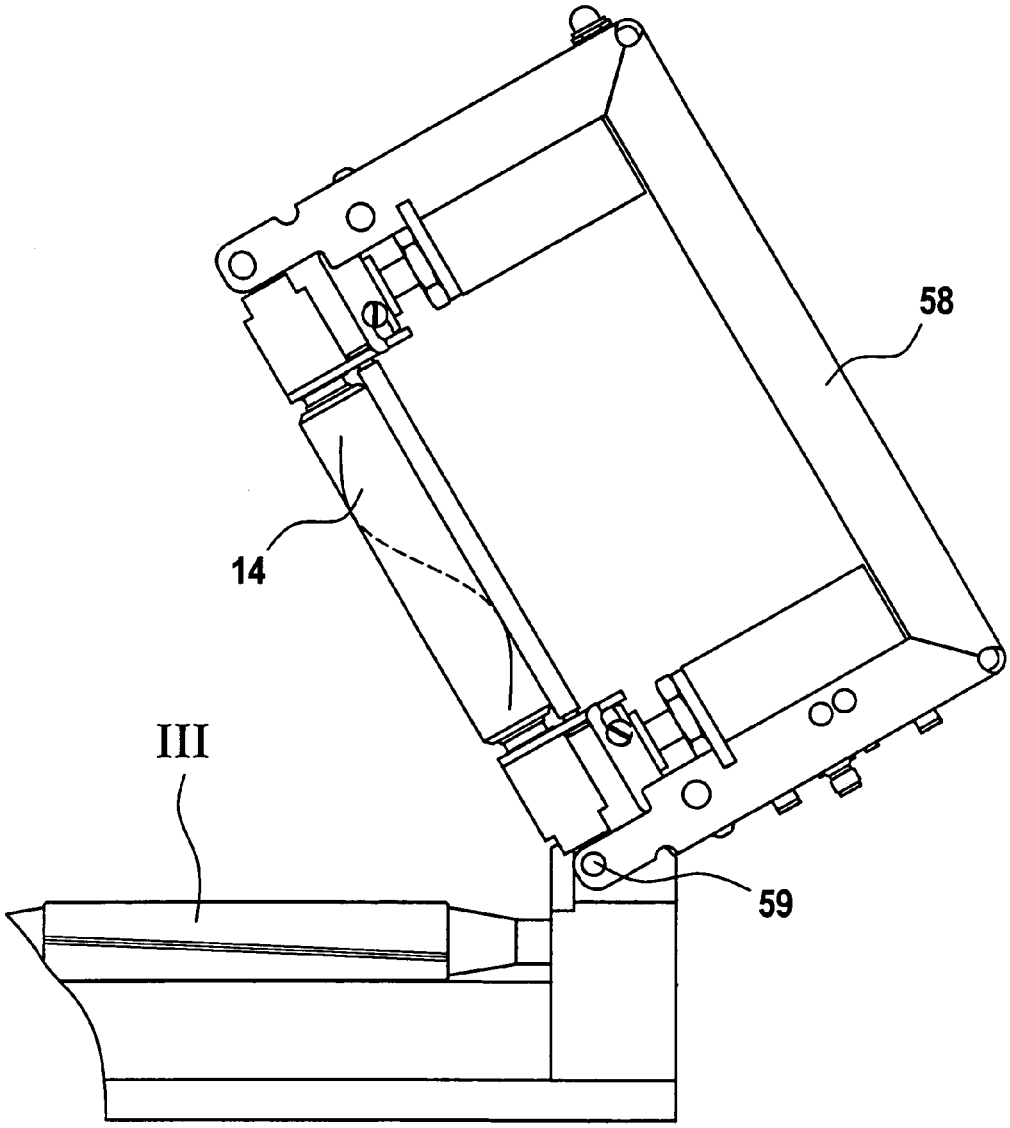
FIG. 11 shows an upper roller lifted off from a lower roller.

In accordance with FIG. 10, the drive motor 19 for lower rollers II and III is in communication with the electronic control and regulation device 26. Adjustment values for modification of the draft zones VV and HV (that is to say the extents of the drawing zones) either can be entered manually by way of the input device 29 or can be called up from a memory 31 for particular categories of fibre material.

Adjustment of the nip line spacing in the preliminary draft zone VV and/or the main draft zone HV can be carried out with the fibre slivers 5 inserted.

Displacement can be carried out with the upper rollers 11 to 14 in the loaded state. FIGS. 1 and 10 show inserted fibre slivers 5 and loaded upper rollers 11 to 14. With the fibre slivers inserted 35*a,* 36*a* or mountings of at least one lower roller II, III are unlocked, the sliders or mountings are set to the desired nip line spacing a, a'; b, b' by means of a displacement device, for example in accordance with FIGS. 3*a,* 3*b;* 5*a,* 5*b* and then sliders 35*a,* 36*a* or mountings are locked again (for example in accordance with (FIG. 7).

Displacement can also be carried out with the upper rollers 11 to 14 lifted off. The upper rollers 11 to 14 may be lifted off completely from the lower rollers I to III in the manner shown in DE-OS 197 04 815, the upper roller 14 being swung out on a portal 58 about a pivot mounting 59. However, it may also be sufficient for the upper rollers 11 to 14 to be unloaded and to be lifted off from the lower rollers I to III only to a slight degree such that the fibre slivers 5 are not caught by the pairs of rollers during displacement of the draft zones VV and HV but can slide through the roller nip without being adversely affected.

The invention has been illustrated using the example of the adjustment of the nip line spacings of a drawing mechanism of a draw frame. It likewise encompasses the adjustment of drawing mechanisms of other machines, for example carding machines, combing machines, fly frames and ring spinning frames.

The invention claimed is:

1. An apparatus at a draw frame having a drawing mechanism for the doubling and drafting of fibre slivers, having a drawing mechanism frame for accommodating the drawing mechanism, which has at least two pairs of rollers each comprising an upper roller and a lower roller, having means for adjusting the spacing of a least one of the lower rollers in relation to another lower roller, in each case having a mounting device for accommodating the lower roller, wherein lower rollers are arranged to be driven by at least one drive element endlessly revolving around pulley wheels, wherein at least one pulley wheel and the tensioned drive element are used for adjusting the mounting device wherein a moving force applied to the pulley wheel or to the drive element can be converted into the adjusting movement for the mounting device.

2. The apparatus according to claim 1 wherein the drive element is stationary and the pulley wheel is rotated.

3. The apparatus according to claim 1 wherein the pulley wheel is stationary and the drive element is moved.

4. The apparatus according to claim 3 wherein a brake or a stopping arrangement is associated with the stationary pulley wheel.

5. The apparatus according to claim 1 wherein at least one guide pulley wheel and at least one-roller-driving pulley wheel are attached to each mounting device; and the at least one roller-driving pulley wheel or guide pulley wheel act, in each case one after the other, on both sides of the tensioned drive element.

6. The apparatus according to claim 1 wherein the rotation of the pulley wheel or the movement of the drive element is accomplished manually.

7. The apparatus according to claim 1 wherein the mounting device is linearly displaceable.

8. The apparatus according to claim 1 wherein the drive element is a toothed belt.

9. The apparatus according to claim 8 wherein belt shortening or belt lengthening is arranged to be automatically evened out during adjustment.

10. The apparatus according to claim 9 wherein the evening-out of belt length is carried out at a slider by two guide pulley wheels.

11. The apparatus according to claim 1 further comprising an endless flexible toothed belt.

12. The apparatus according to claim 1 wherein the pulley wheels comprise toothed belt wheels.

13. The apparatus according to claim 1 wherein the pulley wheels comprise guide pulley wheels.

14. The apparatus according to claim 1 further comprising at least one driving pulley wheel.

15. The apparatus according to claim 1 further comprising driven pulley wheels.

16. The apparatus according to claim 1 wherein the drive element loops around the pulley wheels.

17. The apparatus according to claim 1 wherein the drive element and the pulley wheels are in engagement with one another.

18. The apparatus according to claim 1 wherein the pulley wheel for adjustment of the mounting device is a drive pulley wheel of a lower roller.

19. The apparatus according to claim 1 wherein the mounting device is displaceable during adjustment.

20. The apparatus according to claim 1 wherein the mounting device is arranged to be stopped.

21. The apparatus according to claim 20 wherein the stopping arrangement is releasable.

22. The apparatus according to claim 1 further comprising a display device for the position of the mounting device.

23. The apparatus according to claim 1 further comprising a drive motor used for rotation of the pulley wheel.

24. The apparatus according to claim 23 wherein the drive motor is in communication with an electronic control and regulation device.

25. The apparatus according to claim 24 wherein a measuring element is connected to the control and regulation device.

26. The apparatus according to claim 25 wherein the measuring element is capable of registering fibre-related and/or machinery-related measurement variables.

27. The apparatus according to claim 24 wherein a memory for adjustment variables is connected to the control and regulation device.

28. The apparatus according to claim 23 wherein the drive motor is a self-braking motor.

29. The apparatus according to claim 23 wherein the drive motor drives a further drive train, which has a free-wheel arrangement.

30. The apparatus according to claim 1 further comprising a drive motor used for movement of the drive element.

31. The apparatus according to claim 1 further comprising a drive motor used for the lower rollers.

32. The apparatus according to claim 1 further comprising a separate drive motor.

33. The apparatus according to claim 1 wherein the lower rollers are arranged to be adjusted singly and independently of one another.

34. The apparatus according to claim wherein a roller-driving pulley wheel and a guide pulley wheel are attached to a slider of an intake roller and a roller-driving pulley wheel and a guide pulley wheel are attached to a slider of a middle roller.

35. The apparatus according to claim 34 wherein the drive element runs around the pulley wheels at the slider of the intake roller and round the pulley wheels at the slider of the middle roller in a mirror-reflected arrangement.

36. The apparatus according to claim 34 wherein the slider for the intake roller and the slider for the middle roller are arranged to be connected by a rigid connecting element.

37. The apparatus according to claim 36 wherein the connecting element is releasably connected.

38. The apparatus according to claim 34 wherein the intake and middle lower rollers are arranged to be driven by one drive motor.

39. The apparatus according to claim 1 wherein the drive element is in tension.

40. The apparatus according to claim 1 wherein adjustment of the mounting device is carried out when the draw frame is in operation.

41. The apparatus according to claim 1 wherein adjustment of the mounting device is carried out when the draw frame is not in operation.

42. The apparatus according to claim 1 wherein adjustment of the mounting device is carried out during can-changing.

43. The apparatus according to claim 1 wherein the draw frame is self-adjusting.

44. The apparatus according to claim 1 wherein adjustment of the mounting device is carried out by inputting adjustment variables.

45. The apparatus according to claim 44 wherein the adjustment variables can be input manually.

46. The apparatus according to claim 1 wherein the spacing of the pairs of rollers in relation to one another can be adjusted without fibre material.

47. The apparatus according to claim 1 wherein the spacing of the pairs of rollers in relation to one another can be adjusted with fibre material.

48. The apparatus according to claim 1 wherein the extent of a preliminary draft zone can be adjusted.

49. The apparatus according to claim 1 wherein the extent of a main draft zone can be adjusted.

50. The apparatus according to claim 1 wherein the extent of a preliminary draft zone and the extent of a main draft zone can be adjusted.

51. The apparatus according to claim 1 wherein each lower roller has its own associated drive motor.

52. The apparatus according to claim 1 further comprising a mechanical brake or a stopping arrangement.

53. The apparatus according to claim 1 further comprising an electrical brake or a stopping arrangement.

54. The apparatus according to claim 1 further comprising an electromagnetic brake or a stopping arrangement.

55. The apparatus according to claim 1 wherein the at least two drawing mechanism roller combinations include at least three drawing mechanism roller combinations, of which at least two are so mounted that they can be adjusted.

56. The apparatus according to claim 1 wherein the mounting device consists of a mounting and a slider.

57. The apparatus according to claim 56 wherein the mounting and the slider are fastened to one another, for example by bolts.

58. The apparatus according to claim 56 wherein the mounting and the slider are of integral construction.

59. A method for adjusting nip line spacing in a drawing mechanism of a draw frame for fibre slivers, the drawing mechanism including at least two adjustable mounting devices defining a nip line spacing therebetween, each mounting device including at least one lower roller and at least one upper roller adjustably loaded on top of the lower roller, and at least one of the at least two mounting devices including a pulley wheel in driving connection with a driving element, the method comprising:

unlocking at least one of the at least two mounting devices;

adjusting the nip line spacing between the at least two mounting devices via the drive element; and relocking the at least one of the at least two mounting devices.

60. The method according to claim 59 further comprising unloading the upper rollers of each mounting device before performing the steps of unlocking, adjusting, and relocking.

61. The method according to claim 59 further comprising inserting the fibre slivers into the drawing mechanism before performing the steps of unlocking, adjusting, and relocking.

62. The method according to claim 59 wherein the at least two mounting devices include first and second mounting devices, the drawing mechanism further comprising a third mounting device including a delivery roller combination, the nip line spacing between the first mounting device and the second mounting device defining a preliminary draft zone, and the nip line spacing between the second mounting device and the third mounting device defining a main draft zone, the method further comprising adjusting the nip line spacing in at least one of the preliminary draft zone and the main draft zone via the drive element; and simultaneously or subsequently, drawing straight a sagging fibre sliver loop in the main draft zone.

63. The method according to claim 62 further comprising rotating the delivery roller combination in a work direction to draw straight the sagging fibre sliver loop.

64. The method according to claim 62 further comprising rotating the delivery roller combination contrary to a work direction to form the sagging fibre sliver loop.

65. An adjustable drawing mechanism in a draw from for fibre slivers, the adjustable drawing mechanism comprising:

at least two adjustable mounting devices defining a nip line spacing therebetween, each mounting device including at least one lower roller; and at least one upper roller adjustably mounted on top of the lower roller, wherein at least one of the at least two mounting elements includes a pulley wheel in driving connection with a driving element, the pulley wheel and the driving element being adapted to adjust the nip line spacing of at least one of the at least two mounting devices in relation to another of the at least two mounting devices.

66. The adjustable drawing mechanism according to claim 65 further comprising a stopping arrangement configured to stop the drive element, the pulley wheel being adapted to rotate.

67. The adjustable drawing mechanism according to claim 65 further comprising a stopping arrangement configured to stop the pulley wheel, the drive element being adapted to move.

* * * * *